United States Patent [19]

Lindsey

[11] Patent Number: 4,889,141

[45] Date of Patent: Dec. 26, 1989

[54] SHOWER TOILETRIES KIT

[76] Inventor: William J. Lindsey, 1004 East Durant, Apt. 3, Aspen, Colo. 81611

[21] Appl. No.: 272,767

[22] Filed: Nov. 17, 1988

[51] Int. Cl.[4] ..... B65D 71/00

[52] U.S. Cl. ..... 132/286; 206/77.1; 206/581; 132/291

[58] Field of Search ..... 206/77.1, 581, 235, 206/823; 132/286, 289, 290, 291, 314, 316

[56] References Cited

U.S. PATENT DOCUMENTS

| | | | |
|---|---|---|---|
| 1,551,434 | 8/1925 | Shiffer | 132/286 |
| 2,411,196 | 11/1946 | Dolan | 132/289 |
| 2,576,560 | 11/1951 | Bidmon | 206/77.1 |
| 3,099,272 | 7/1960 | Paradis | 132/316 |
| 3,142,415 | 7/1964 | Louchheim | 221/96 |
| 3,187,757 | 6/1965 | Jones | 132/314 |
| 3,228,737 | 1/1966 | Kipnis | 206/581 |
| 3,426,768 | 2/1969 | Vardaros | 132/315 |
| 3,486,630 | 12/1969 | Ellman | 132/289 |
| 4,085,867 | 4/1978 | Heller | 222/181 |
| 4,280,643 | 7/1981 | Cordova et al. | 206/77.1 |
| 4,592,478 | 6/1986 | Laconis | 206/77.1 |
| 4,611,716 | 9/1986 | Sorlien | 206/77.1 |

*Primary Examiner*—Gene Mancene
*Assistant Examiner*—Lepiane: Adriene J.

[57] ABSTRACT

The invention is an assembly of soap dish, drinking cup, mirror, shaver and various bottles of shampoo and the like which are mounted into a single structure which attaches to the wall of a shower room providing convenience and ease of use in the shower. The assembly is small enough to fit into a small locker or be carried in a sports bag. Bottles of shampoo and the like are mounted to, and easily dismounted from, the structure and a tongue in groove method.

2 Claims, 2 Drawing Sheets

SHOWER TOILETRIES KIT

BACKGROUND OF THE INVENTION

The invention relates to dispensing containers and more particularly to kits or assemblies of containers and holders whereby a variety of dispensing or holding functions are combined into a single portable unit capable of meeting a wide range of related functions especially related to grooming.

DESCRIPTION OF THE PRIOR ART

The prior art teaches a variety of devices designed to hold and dispense grooming materials and aids. U.S. Pat. No. 3,187,757 teaches compartmental storage of toilet articles within a cylindrical drum. The object of this invention is to provide a compact form of storage and use for a number of related toiletries. U.S. Pat. No. 3,099,272 teaches the use of a mirror in conjuction with a dispensing tube containing a cosmetic enclosed within a portable, folding case. U.S. Pat. No. 3,142,415 teaches a mountable shelf unit with built in cosmetic reservoir and dispensing pump. U.S. Pat. No. 3,426,768 relates to a portable cosmetic case which serves to provide easy access to a variety of makeup products. U.S. Pat. No. 4,085,867 teaches the method of using an assortment of bottles mounted onto a permanent bracket and held in the inverted position for dispensing grooming materials used in the shower.

None of the prior art disclosures show the combination of features and capabilities of the instant invention. It is the applicant's opinion that the combination of storage and dispensing features, simple mounting scheme and the method of holding dispensing bottles in a monolithic structure is very useful, quite different from the prior art and contain the inventive inspiration required to be granted a U.S. Patent.

SUMMARY OF THE INVENTION AND OBJECTS

Fundamentally, the within invention consists of a kit for use within the shower during washing, shaving, shampooing etc. The kit is small enough to be stored within a small locker, drawer or hand bag, yet contains all of the grooming aids and materials required in the shower. The kit provides means for mounting either to the shower head or the shower wall while in use. The kit contains a soap dish, a drinking cup, a razor, a mirror, and up to four bottles ostensibly for liquid shampoo soap, shampoo rinsing agent, shaving gel or foam and aftershave lotion. Of course the contents of the bottles and the use of the holders are optional with the possible variations being quite large.

The bottom of the soap dish is formed into a frame whereby grooves in the bottom of the bottles permit the insertion and rigid holding of the bottles by the frame. The bottles are mounted in the inverted orientation in order to assure contact between contents and nozzle and thus assure continuous, smooth flow during dispensing. The cap of each bottle is a nozzle having either a pull or twist to open feature so that simple finger pressure on the side of the bottle produces dispensing action.

It is one object of the instant invention to provide a new and unique combination device which is designed to overcome the considerable drawbacks found in prior art devices.

Another object and prominent feature of the within invention is to provide an integral assembly which has such weight and overall size that it can be easily carried about, mounted into position and easily stored.

Another important object of the described invention is to provide the ability to place shower and grooming aids at the exact position within the shower stall to afford maximum convenience and utility of use.

A yet still further important and primary object of the invention is to provide a unique combination of the character and type disclosed herein to provide an adaptable combination unit which is easily reconfigured to support a wide variety of grooming habits and needs.

These, together with the various ancillary objects and features of the invention which will become apparent as the following description proceeds, are attained by this combination assembly providing the convenience of bringing together in one kit a bar of soap, razor for shaving, shaving mirror, drinking cup and up to four liquid grooming materials, preferred embodiments thereof being shown in the accompanying drawings, by way of example only.

DESCRIPTION OF THE PREFERRED EMBODIMENT

Figure 1:
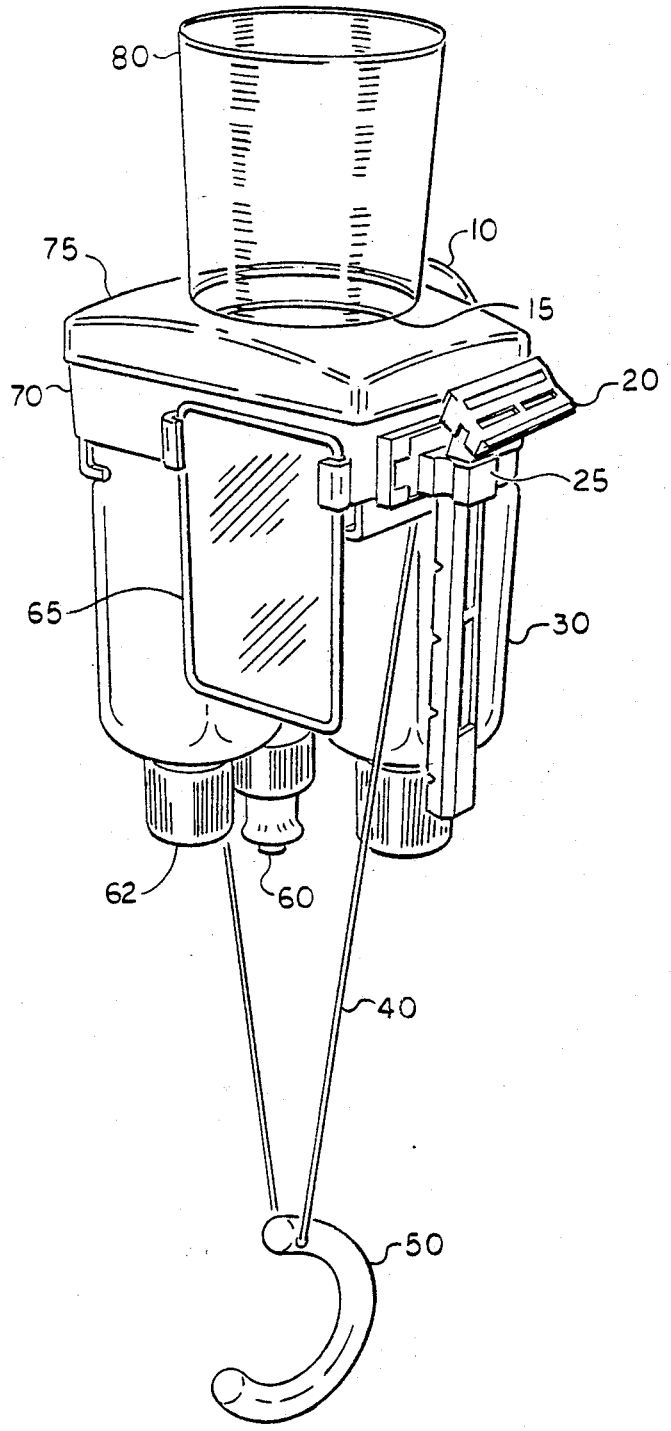
FIG. 1 is a perspective drawing of the instant invention.
Figure 2:
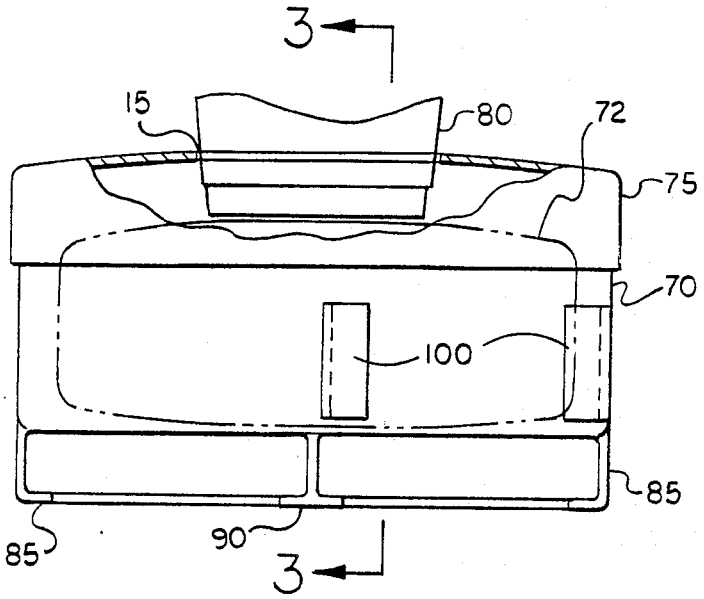
FIG. 2 is an elevation showing details of soap dish and bottle mounting means.
Figure 3:
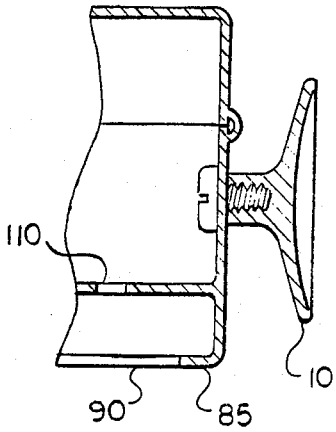
FIG. 3 is a vertical section taken through FIG. 2.
Figure 4:
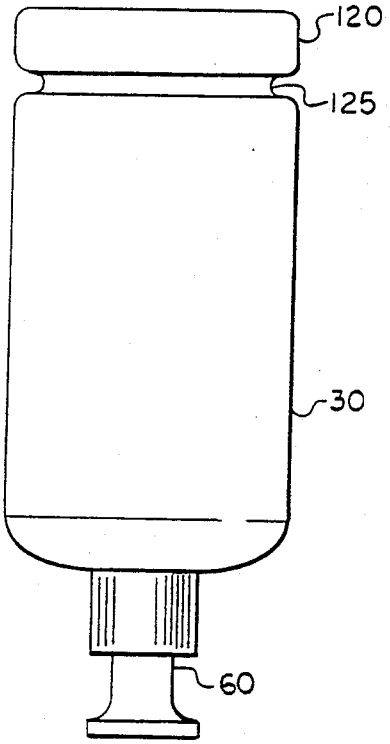
FIGS. 4 and 5 show details of bottles which slide into bottle mounting means.
Figure 5:
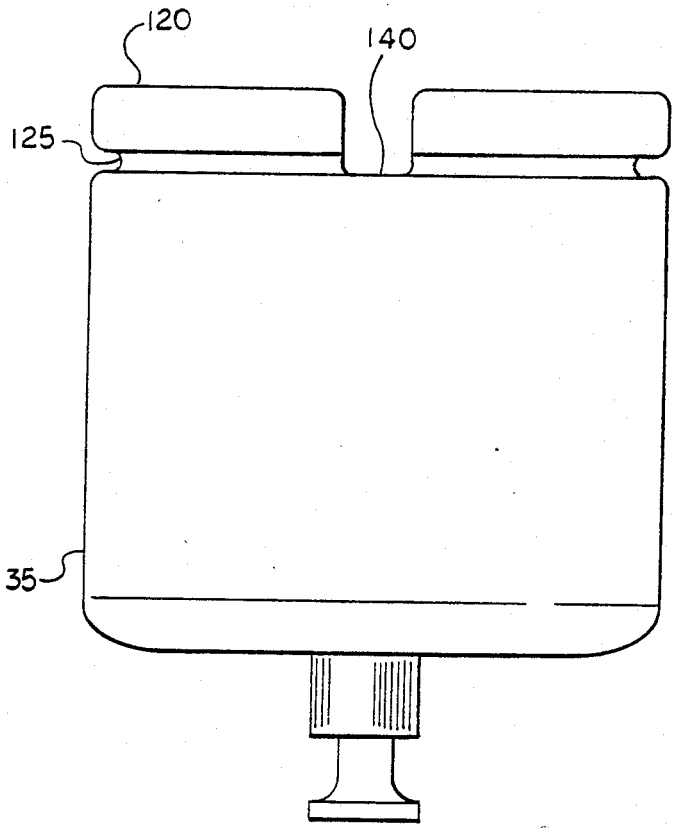

With reference to FIG. 1 there is shown a combination soap dish, drinking cup, razor for shaving, mirror and bottle holder for liquid shampoo or the like. Soap dish 70 has a tight fitting cover 75 which has an aperture 15 into which is inserted a drinking cup 80 and held by wedge action. Bar of soap 72 is stored within soap dish 70. Mounted onto the side walls of soap dish 70 are a mirror 65 on the front face, a razor holder 25 such as described in U.S. Pat. No. 4,240,604, a razor 20 such as produced by The Gillette Razor Co. of Boston, MA. on one side, and a suction cup 10 as described in U.S. Pat. No. 4,734,027 on the rear. Mirror 65 is held by clasp set 100. Base 120 of bottle 30 is inserted between "L" channel 85 and "T" channel 90 with groove 125 mating with channels 85 and 90 on two sides. Alternately, inserted between two "L" channels 85 is large bottle 35 with slot 140 straddling "T" channel 90. Hanging from soap dish 70 and attached thereto on two sides is string 40 supporting utility hook 50. Small bottle 30 and large bottle 35 contain nozzle 60 or 62 which may be any one of several commercially available squeeze bottle nozzles such as Auto-cap by Calmar Inc. of Watchung, NJ. "L" channels 85 extend around the edge of soap dish 70 on three sides leaving the fourth side open for inserting bottles 30, 35. The fourth, or open side may be the front as is shown in FIGS. 1, 2 and 3 or it may be any other sides of soap dish 70.

OPERATION OF THE INVENTION

The described invention is small enough to be carried inside a sports bag and stored within a small locker. In use it is mounted inside the shower stall by either suspending it from a shower head pipe by utility hook 50 or by mounting directly to the shower stall wall with suction cup 10, or both. If suction cup 10 is used alone for mounting then utility hook 50 can dangle as shown in FIG. 1 and may be used to support a comb, brush, wash cloth or other grooming aid. With cup 80 removed and placed aside, cover 75 can be opened providing access to soap bar 72. Shaving gel in one of bottles 30, mirror 65 and razor 20 are used in combination within the shower to shave the face. With soap bar 72 removed, soap dish 70 may be filled with hot water which heats mirror 65 by conduction maintaining a condensation free mirror 65. Bottle 30 or 35 is in direct contact with the bottom of soap dish 70 so that it can be used to cover drain hole 110 to prevent drainage of the hot water. Dispensing of the contents of bottles 30, 35 is accomplished by actuating the nozzle and pressing or squeezing the sides of the selected bottle 30, 35. Liquid shampoo soap, shampoo rinse agent and other toiletries can be dispensed from bottles 30, 35. In the preferred embodiment three possible combinations of bottles 30, 35 may be inserted below soap dish 70. These combinations are: four small bottles 30, two large bottles 35 or two small bottles 30 with one large bottle 35.

Having thus described my invention what I claim as new, useful and non-obvious and, accordingly secure by Letters Patent of the U.S. is:

1. A shower toiletries kit comprising, in combination:

a rectangular soap dish having a front, a back and two sides, a flat bottom surface and an open top, and a rectangular cover having four sides, a top surface and an open bottom, said cover being removable and fitting tightly to said soap dish forming a complete enclosure and thereby holding a bar of soap within, said cover having an aperture in said top surface, said aperture being a holding means for a drinking cup inserted therein, said soap dish having at least one drain hole in said bottom surface, inward facing "L" shaped channels attached along the full length of three edges of said bottom surface and an inverted "T" shaped channel attached at the center of said bottom surface, said "T" shaped channel being located equidistant from and parallel to two said "L" shaped channels, said soap dish having a mirror mounted on said front and a suction cup mounted on said back and a razor mounted on one side, and at least one container for liquid shampoo or the like, comprising a bottle made of soft plastic and having a removable dispensing cap capable of being toggled between dispensing and nondispensing modes without being removed from said bottle, said bottle having grooves on each side adjacent to the base and oriented parallel to the bottom surface of said bottle, said grooves being capable of accepting said "L" shaped channels, said bottle being wide enough to fit between two parallel "L" shaped channels, and said bottom of said bottle having a slot cutout, said slot being large enough to fit over said "T" shaped channel without interference, and a string, being attached at two opposite sides of said soap dish, said string having attached thereto a hook, the diameter of said hook exceeding the diameter of a standard shower pipe, whereby at least one said container is inserted into said channels, said bar of soap is stored in soap said dish and said drinking cup is inserted into said aperture in said cover, and said hook is inserted over said shower pipe thus positioning said kit for use and providing a compact, convenient and easily used source of grooming aids and toiletries during and immediately after showering.

2. A method of using a shower toiletries kit comprising in combination a rectangular soap dish having a front, a back and two sides, a flat bottom surface and an open top, and a rectangular cover having four sides, a top surface and an open bottom, said cover being removable and fitting tightly to said soap dish forming a complete enclosure and thereby holding a bar of soap within, said cover having an aperture in said top surface, said aperture being a holding means for a drinking cup inserted therein, said soap dish having at least one drain hole in said bottom surface, inward facing "L" shaped channels attached along the full length of three edges of said bottom surface and an inverted "T" shaped channel attached at the center of said bottom surface, said "T" shaped channel being located equidistant from and parallel to two said "L" shaped channels, said soap dish having a mirror mounted on said front and a suction cup mounted on said back and a razor mounted on one side, and at least one container for liquid shampoo or the like, comprising a bottle made of soft plastic and having a removable dispensing cap capable of being toggled between dispensing and nondispensing modes without being removed from said bottle, said bottle having grooves on each side adjacent to the base and oriented parallel to the bottom surface of said bottle, said grooves being capable of accepting said "L" shaped channels, said bottle being wide enough to fit between two parallel "L" shaped channels, and said bottom of said bottle having a slot cutout, said slot being large enough to fit over said "T" shaped channel without interference, and a string, being attached at two opposite sides of said soap dish, said string having attached thereto a hook, the diameter of said hook exceeding the diameter of a standard shower pipe, said method comprising the steps;

inserting at least one said container into said channels, storing said bar of soap in said soap dish, inserting said drinking cup into said aperture in said cover, and placing said hook over said shower pipe, or securing said suction cup to shower wall, positioning said container in said channels to block water drainage from said soap dish through said drain hole, filling said soap dish with hot water, to cause heating of said mirror in order to prevent fogging of said mirror during shaving or in the alternative repositioning said container to unblock said drain hole providing means for water drainage from said soap dish.

* * * * *